US007476163B2

(12) United States Patent
Kasashima

(10) Patent No.: US 7,476,163 B2
(45) Date of Patent: Jan. 13, 2009

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 656 days.

(21) Appl. No.: 10/684,688

(22) Filed: Oct. 15, 2003

(65) Prior Publication Data

US 2004/0082409 A1 Apr. 29, 2004

(30) Foreign Application Priority Data

Oct. 17, 2002 (JP) ..... 2002-303187

(51) Int. Cl.
*A63B 37/14* (2006.01)

(52) U.S. Cl. ..... 473/383

(58) Field of Classification Search ..... 473/378–384
See application file for complete search history.

(56) References Cited

U.S. PATENT DOCUMENTS

| | | | | |
|---|---|---|---|---|
| 1,483,165 | A * | 2/1924 | Eaton | 473/281 |
| 1,681,167 | A * | 8/1928 | Beldam | 473/383 |
| 2,002,726 | A * | 5/1935 | Young | 473/383 |
| 4,830,378 | A * | 5/1989 | Aoyama | 473/384 |
| 4,979,747 | A * | 12/1990 | Jonkouski | 473/377 |
| 5,566,943 | A * | 10/1996 | Boehm | 473/378 |
| 5,677,796 | A * | 10/1997 | Zimmerman et al. | 359/654 |
| 5,890,975 | A * | 4/1999 | Stiefel | 473/384 |
| 6,290,615 | B1 | 9/2001 | Ogg | |
| 6,569,038 | B2 * | 5/2003 | Sullivan | 473/383 |
| 6,595,876 | B2 | 7/2003 | Kasashima et al. | |
| 6,884,183 | B2 * | 4/2005 | Sullivan | 473/383 |

FOREIGN PATENT DOCUMENTS

| | | |
|---|---|---|
| JP | 60-34468 A | 2/1985 |
| JP | 7-289662 A | 11/1995 |

OTHER PUBLICATIONS

Strictly Golf, Louis G. Caschera, Jr., Michigan: Strictly Golf, Inc., copyright 1998, p. 31.*
Hotchkiss, John, 500 Years of Golf Balls, Iowa: Antique Trader Books, p. 115, copyright 1997.*
Meriam-Websters Dictionary, www.m-w.com.*

* cited by examiner

*Primary Examiner*—Gene Kim
*Assistant Examiner*—Alvin A Hunter
(74) *Attorney, Agent, or Firm*—Sughrue Mion, PLLC

(57) ABSTRACT

In a golf ball, a plurality of flat surface regions, typically hexagonal plane regions are defined on the ball surface. The proportion of the land area in the golf ball surface area is reduced to below 20%, eventually reducing the air resistance of the ball in flight and drastically improving the flight performance.

24 Claims, 4 Drawing Sheets

GOLF BALL

TECHNICAL FIELD

This invention relates to golf balls having improved flight performance.

BACKGROUND ART

As is well known in the art, in order for a golf ball to travel a distance when launched, the rebound properties of the ball itself and the sophisticated arrangement of dimples on the ball surface to reduce the air resistance of the ball in flight are important. To reduce the air resistance, many methods of uniformly arranging dimples over the entire ball surface at a higher density have been proposed.

Most often, dimples are indentations of circular shape as viewed in plane. To arrange such circular dimples at a high density, it will be effective to reduce the width of a land partitioning two adjoining dimples to nearly zero. However, the region surrounded by three or four circular dimples becomes a land of generally triangular or quadrangular shape having a certain area, as part of the spherical surface. On the other hand, it is requisite to arrange dimples on the spherical surface as uniformly as possible. Thus the arrangement density of circular dimples must find a compromise.

Under the circumstances, Kasashima et al., U.S. Pat. No. 6,595,876 (JP-A 2001-212260) attains the purpose of uniformly arranging dimples on a golf ball at a high density, by arranging dimples of 2 to 5 types having different diameters on the spherical surface of the ball which is assumed to be a regular octahedron or icosahedron.

However, as long as circular dimples are used, the percent occupation of the total area of lands (as parts of the spherical surface) over the entire golf ball surface area encounters a practical lower limit of approximately 25%. In order to further reduce the air resistance of a ball in flight, it would be desirable if the dimples arranged on the ball surface are devised so as to reduce the percent occupation of the total land area over the entire golf ball surface area.

SUMMARY OF THE INVENTION

An object of the invention is to provide a golf ball which is improved in flight performance by reducing the percent occupation of the total area of lands (as parts of the spherical surface) over the entire golf ball surface area.

It has been discovered that when the spherical surface of a golf ball is provided with flat surface regions, the proportion of lands as parts of the spherical surface in the golf ball surface is significantly reduced.

According to the present invention, there is provided a golf ball having a spherical surface where flat surface regions are defined.

In a preferred embodiment, the flat surface regions are polygonal or circular plane regions. Most often, a dimple is disposed within each said polygonal or circular plane region, preferably at the center thereof. Typically the golf ball includes 300 to 550 dimples.

Preferably, the total area of lands as the spherical surface accounts for less than 20% of the entire golf ball surface area.

According to the invention, the percent occupation of the total land area over the entire golf ball surface area can be reduced to nearly zero, and the dimples can be arranged on the golf ball surface as uniformly as possible.

DESCRIPTION OF THE PREFERRED EMBODIMENTS

Figure 1:
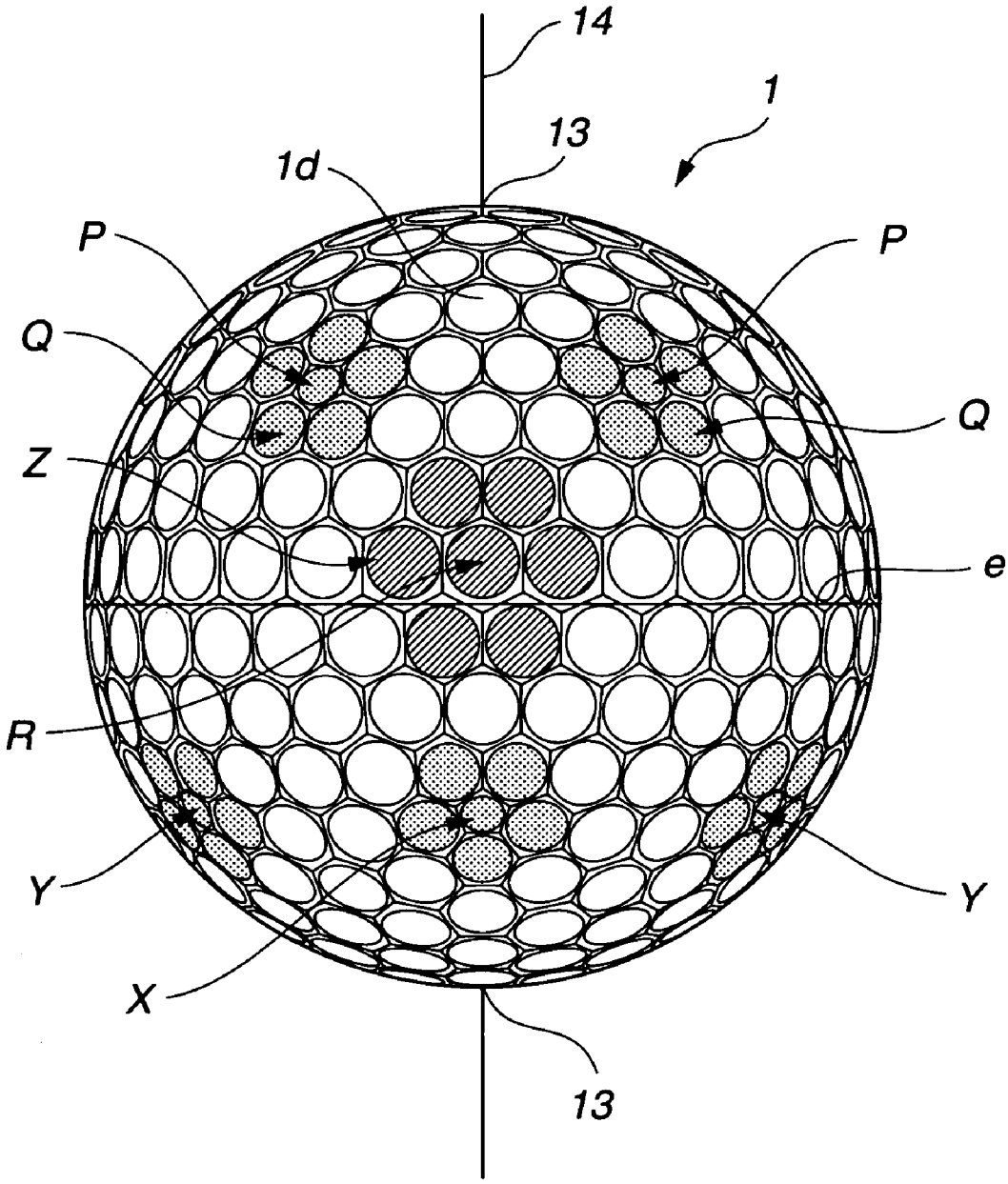
FIG. 1 is an elevational view of a golf ball according to one embodiment of the invention.
Figure 2:
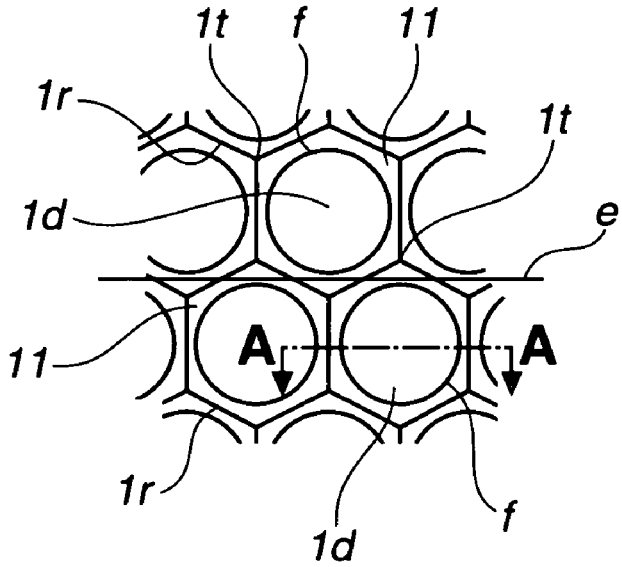
FIG. 2 is an enlarged view of a portion of the golf ball of FIG. 1.

Referring to FIG. 1, a golf ball 1 according to one embodiment of the invention is illustrated in an elevational view. FIG. 2 is an enlarged view of a central portion of the golf ball of FIG. 1. It is noted that the golf ball 1 has a spherical surface (12), a center (not shown), opposite poles 13, an axis 14 connecting the poles 13, and an equator "e" dividing the ball into hemispheres.

The golf ball 1 in one embodiment of the invention has a spherical surface where a plurality of annularly extending flat surface regions or planar regions are defined. In the majority of the golf ball surface, hexagonal zones circumscribed or delimited by six linearly extending ridge-lines 1*r* are defined as hexagonal plane regions 11, within each of which a dimple 1*d* is disposed so that the hexagonal plane region is left as an annular region. It is noted that the dimple 1*d* is circumscribed by a circular edge "f" where the dimple merges with the hexagonal plane region.

The flat surface regions are typically polygonal plane regions. Although the polygonal plane regions are illustrated as hexagonal plane regions in FIGS. 1 and 2, they may be planar regions of another polygonal shape including triangular, quadrangular, and pentagonal shapes, preferably regular polygon shape, and combinations of any. Circular plane regions are also acceptable insofar as the object of the invention is not compromised.

In the illustrated embodiment of FIGS. 1 and 2, the dimple formed within the plane region has a circular shape as viewed in plane. Similarly, dimples of elliptic, oblong or polygonal (preferably regular polygon) shape as viewed in plane may be used if desired.

The dimples 1*d* are disposed within all the polygonal plane regions 11 in the illustrated embodiment of FIGS. 1 and 2. Some polygonal or circular plane regions devoid of dimples may be arranged on the golf ball surface insofar as the object of the invention is not compromised.

In the golf ball 1, the intersection of three ridge-lines 1*r* each serving as the boundary between two adjacent hexagonal plane regions 11, that is, the apex 1*t* as best shown in FIG. 2 is positioned radially remotest from the center of the golf ball. Then the edge "f" of the dimple 1*d* is not positioned radially remotest from the center of the golf ball.

In molding the golf ball according to the invention, a mold of split type may be used. The mold defines in the interior a spherical cavity whose inner surface is provided with flat portions for forming the plane regions and optionally, protrusions for forming the dimples on the surface of a golf ball being molded therein.

Figure 3:
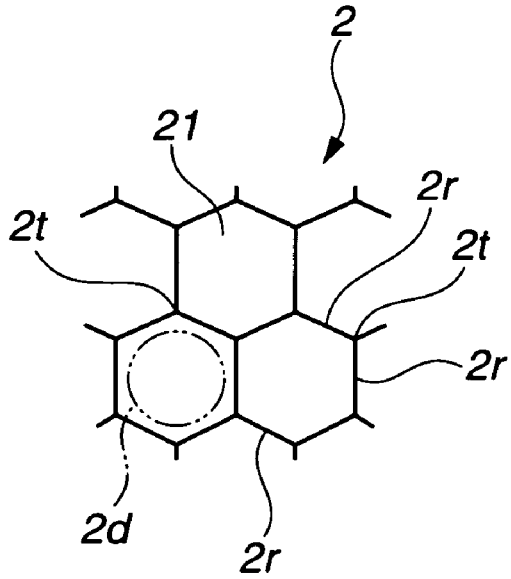
FIG. 3 is an enlarged view of a portion of a hemispherical master for use in the preparation of a mold intended for the molding of a golf ball according to the invention.

A hemispherical master is conveniently used in the manufacture of the mold. To produce the hemispherical master, a hemispherical block having a plurality of plane regions on the surface is furnished. FIG. 3 illustrates in an enlarged view a portion of one exemplary hemispherical block 2 having a plurality of plane regions on the surface.

The hemispherical block 2 having a plurality of plane regions on the surface is made by machining a smooth hemispherical block to form a first circular plane region having a predetermined radius thereon, and successively machining to form circular plane regions of the same radius around the first plane region so that six circular plane regions are arranged about the first plane region at an equal spacing and overlap (or interfere with) each other. In this process, a straight ridge-line is defined where two adjacent circular plane regions overlap each other, and as a consequence, a hexagonal plane region 21 delimited by six ridge-lines is defined.

In the example shown in FIG. 3, a part of the original spherical surface is left only at the intersection of three ridge-lines 2*r*, that is, at the apex 2*t*. If the overlap or interference between adjacent circular plane regions is relatively small, the length of ridge-line 2*r* becomes short, and eventually, a land having a relatively large area is left near the position corresponding to the apex 2*t* as a part of the original spherical surface.

The process of manufacturing the hemispherical master further involves engraving the hemispherical block 2 having a plurality of plane regions 21 machined on the surface to form dimples 2*d*. Each dimple 2*d* is typically engraved within a single plane region 21. Alternatively, the dimple 2*d* is engraved so as to extend to outside of that plane region so that the dimple 2*d* may straddle adjacent plane regions. However, if many such straddling dimples extending over the position of the apex 2*t* are formed, then the outer diameter of the golf ball itself is reduced, with a likelihood that there is eventually manufactured a mold from which golf balls not conforming to the rule of golf are produced.

To avoid such failure, it is recommended that a dimple 2*d* having a planar view shape falling within the plane region 21 be engraved on the hemispherical block 2 using as the reference the coordinates used in forming the plane regions 21.

In the practice of the invention, a golf ball is molded in a mold of two split halves which are manufactured using a hemispherical master as prepared above. The golf ball which is molded has substantially the same spherical contour as the hemispherical master.

In FIG. 2, each ridge-line 1*r* is a straight line having no width in a substantial sense, and each apex 1*t* is a point having no area in a substantial sense, as literally interpreted. In molding the golf ball in a mold which is manufactured using the hemispherical master comprising lands of a relatively large area positioned near the apexes 2*t*, lands as parts of the spherical surface, which correspond to the lands on the hemispherical master, are formed near the positions corresponding to the apexes 1*t* where three ridge-lines 1*r* intersect. The lands as the spherical surface are formed as parts of the spherical surface (the remainder of the spherical surface) as in the case of the hemispherical master, and thus positioned radially remotest from the center of the golf ball.

The proportion of the total area of lands as parts of the spherical surface in the entire surface area of the golf ball is preferably less than 20%, especially less than 15%. If this proportion is more than 20%, flight distance may not be increased due to greater air resistance. It is understood that if the portion of the golf ball corresponding to the apex 1*t* defined as the intersection of three ridge-lines 1*r* is a point having no area, then the proportion of the total area of lands as the spherical surface in the entire surface area of the golf ball becomes substantially 0%.

Figure 4:
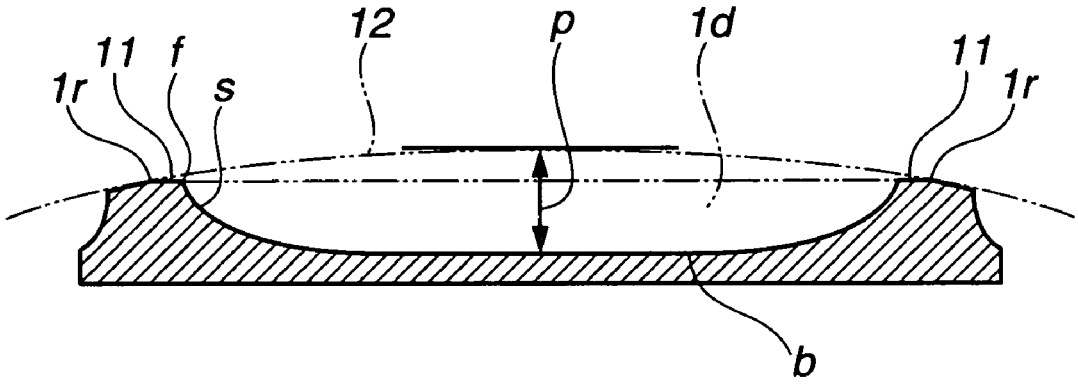
FIG. 4 is a cross-sectional view taken along lines A-A in FIG. 2 of one exemplary dimpled plane region on the inventive golf ball.
Figure 5:
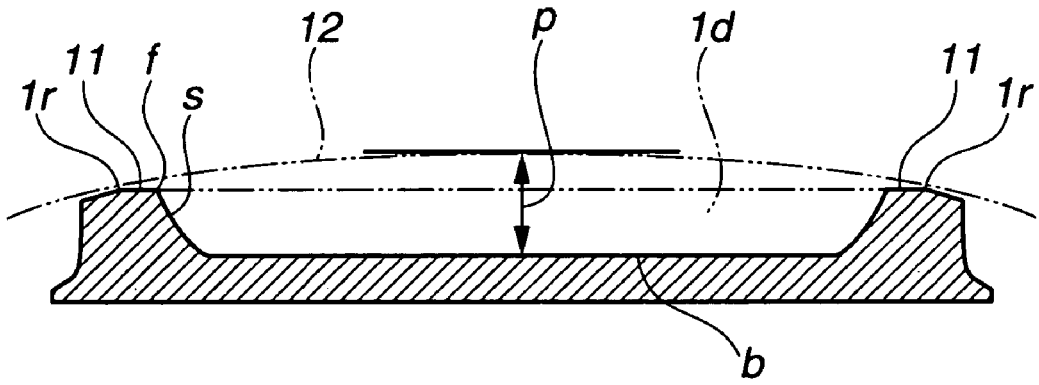
FIG. 5 is a cross-sectional view of another exemplary dimpled plane region on the inventive golf ball.
Figure 6:
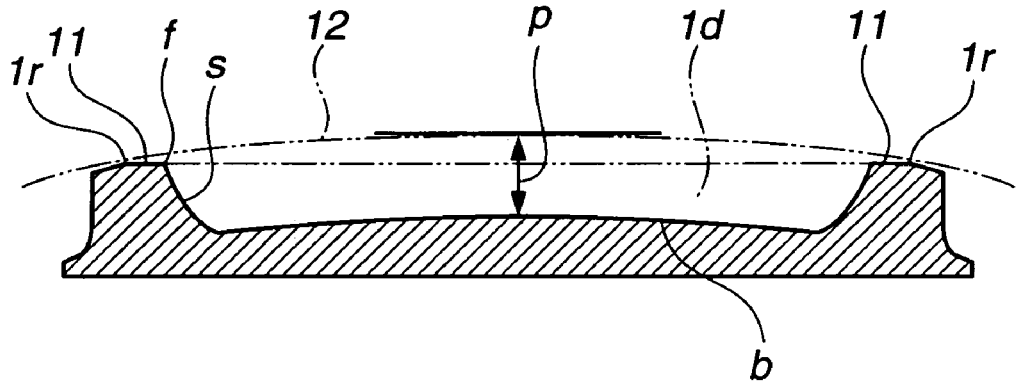
FIG. 6 is a cross-sectional view of a further exemplary dimpled plane region on the inventive golf ball.

Referring to FIGS. 4 to 6, there is illustrated the dimpled plane region in cross section taken along lines A-A in FIG. 2. It is noted that lines A-A pass the center of the dimple 1*d*.

Figure 7:
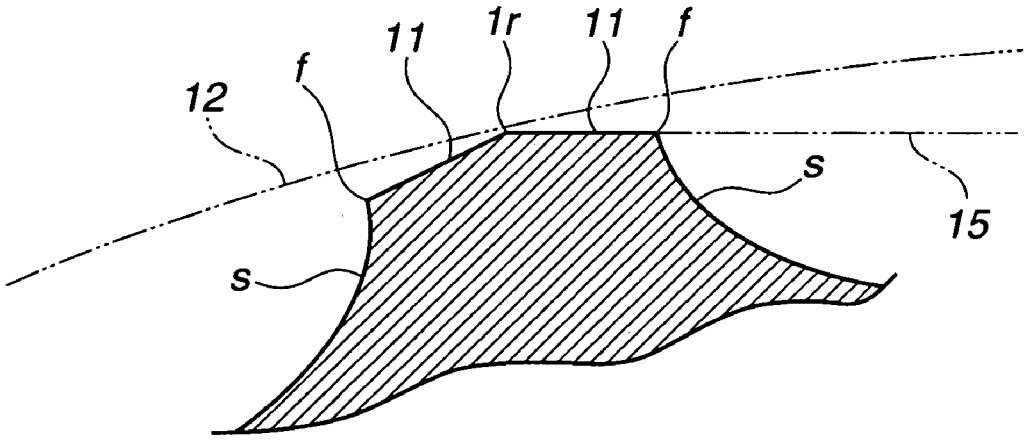
FIG. 7 is an enlarged view of a portion of FIGS. 4 to 6, illustrating a ridge-line portion between two hexagonal plane regions on the inventive golf ball.

In the example of FIG. 4, the annular hexagonal plane region 11 extends at a certain angle from the left and right ridge-lines 1*r*. The dimple 1*d* defining the edge "f" with the annular hexagonal plane region 11 is formed convex toward the center of the golf ball. That is, the dimple 1*d* includes a side "s" and a bottom "b" which are both contoured by curves protruding inward of the golf ball. FIG. 7 is an enlarged view of a portion near the annular hexagonal plane region 11. An imaginary plane 15 is coextensive with the hexagonal plane region 11.

In the example of FIG. 5, the dimple is characterized in that the side "s" extends relatively sharply from the edge "f" of the dimple circumscribed by the annular hexagonal plane region 11 and merges with the flat bottom "b" which extends substantially parallel to the annular hexagonal plane region 11.

In the example of FIG. 6, the dimple is analogous to the example of FIG. 5 in that the side "s" extends relatively sharply from the edge "f" of the dimple toward the bottom "b," but different in that the bottom "b" extends substantially parallel to or concentric with an imaginary spherical surface 12 passing the apex 1*t*, the intersection of ridge-lines 1*r*.

For the dimples of circular shape, the diameter of dimple as determined using the position of edge "f" as reference is usually at least 1 mm, preferably at least 2 mm and up to 6 mm, preferably up to 5 mm. For the dimples of polygonal shape, the maximum apex-to-apex distance of dimple as determined using the position of edge "f" as reference is usually at least 1 mm, preferably at least 2 mm and up to 6 mm, preferably up to 5 mm. If the diameter or maximum apex-to-apex distance is larger than the upper limit or smaller than the lower limit, there may result in a shortage of flight distance.

The maximum distance "p" between the imaginary spherical surface 12 circumscribing the apex 1*t* and the bottom "b" of the dimple is usually at least 0.05 mm, preferably at least 0.1 mm and up to 0.4 mm, preferably up to 0.3 mm. If the maximum distance "p" is larger than the upper limit or smaller than the lower limit, there may result in a shortage of flight distance.

When polygon or circle-shaped plane regions each provided with a dimple are arranged on the golf ball surface, any of the spherical icosahedral, dodecahedral, and octahedral patterns and random patterns all known for the dimple arrangement may be utilized. In the illustrated embodiment of FIG. 1, there are arranged pentagonal plane regions P delimited by five ridge-lines and hexagonal plane regions Q and R delimited by six ridge-lines, each centrally provided with a circular dimple.

In FIG. 1, portions depicted at X and Y are pentagonal units which are each formed by arranging five dimpled hexagonal plane regions Q closely about one dimpled pentagonal plane region P. Three pentagonal units X are arranged on a common latitude at intervals of 120° with respect to the axis 14. Similarly, three pentagonal units Y are arranged on a common latitude at intervals of 120° with respect to the axis 14. Then total six pentagonal units X and Y are arranged in each of the hemispheres divided by the equator "e."

The group of pentagonal units X and the group of pentagonal units Y are arranged on substantially the same latitude in the illustrated embodiment. Alternatively, the group of pentagonal units X are arranged at a relatively high latitude and the group of pentagonal units Y are arranged at a relatively low latitude.

Over the surface area of the golf ball excluding the pentagonal units X and Y, hexagonal plane regions each provided with a dimple are closely packed. That is, hexagonal units Z which are each formed by arranging six dimpled hexagonal plane regions closely about one dimpled hexagonal plane region R are arranged over the remaining golf ball surface.

Specifically, with reference to the hexagonal unit Z, a similar hexagonal unit Z can be formed by selecting any one of the six hexagonal plane regions other than the centrally located hexagonal plane region and arranging six hexagonal plane regions about the selected hexagonal plane region so as to surround the selected region (now becoming the centrally located hexagonal plane region).

Also, any one of the hexagonal plane regions other than the pentagonal plane region located at the center of the pentagonal unit X or Y can become one of the six hexagonal plane regions surrounding the hexagonal plane region located at the center of the hexagonal unit Z.

In the illustrated embodiment, the total number of plane regions extending annularly about the dimple is 362, including pentagonal and hexagonal regions.

There has been described a golf ball in which a plurality of flat surface regions are defined on the ball surface. This feature is effective for reducing the proportion of the land area in the golf ball surface area, eventually reducing the air resistance of the ball in flight and drastically improving the flight performance of the ball.

Japanese Patent Application No. 2002-303187 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball having an outermost spherical surface wherein a plurality of flat surface regions are formed on said outermost spherical surface, where areas of said outermost spherical surface which are not formed of said flat regions are land areas on said outermost surface, and a dimple is disposed within said plurality of the flat surface regions.

2. The golf ball of claim 1 wherein said flat surface regions are polygonal or circular plane regions.

3. The golf ball of claim 2 wherein a dimple is disposed within each said polygonal or circular plane region.

4. The golf ball of claim 3 wherein the dimple is centered within each said polygonal or circular plane region.

5. The golf ball of claim 3, including 300 to 550 dimples.

6. The golf ball of claim 2 wherein the polygonal shape includes triangular, quadrangular, pentagonal and hexagonal shapes.

7. The golf ball of claim 1 wherein a total area of the land areas on the spherical surface accounts for less than 20% of the entire golf ball surface area.

8. The golf ball of claim 1 wherein an annular plane region is formed between ridge-lines delimiting the flat surface and the dimples.

9. The golf ball of claim 1 wherein the flat surface regions comprises hexagonal plane regions delimited by six linearly extending ridge-lines.

10. The golf ball of claim 9 wherein the flat surface regions comprise pentagonal plane regions delimited by five ridge-lines.

11. The golf ball of claim 9 wherein each of the ridge-lines has substantially no width.

12. The golf ball of claim 1 wherein the dimple has a circular shape as viewed in plane.

13. The golf ball of claim 12 wherein the dimple has a diameter of 1 to 6 mm.

14. The golf ball of claim 12 wherein the dimple has a depth of 0.05 to 0.4 mm.

15. The golf ball of claim 1 wherein the dimple is formed with a side and a bottom which are both contoured by curves protruding inward.

16. The golf ball of claim 1 wherein the dimple is formed with a bottom which extends substantially parallel to the flat surface region and a side which extends relatively sharply from an edge of the dimple and merges with the bottom.

17. The golf ball of claim 1 wherein the dimple is formed with a bottom which extends substantially concentric with a spherical surface of the ball and a side which extends relatively sharply from an edge of the dimple and merges with the bottom.

18. A golf ball having an outermost spherical surface wherein a plurality of flat surface regions are formed on said outermost spherical surface, where areas of said outermost spherical surface which are not formed of said flat regions are land areas on said outermost surface, and a dimple is disposed within said plurality of the flat surface regions, wherein some of the flat surface regions devoid of dimples are arranged on the spherical surface of the ball.

19. A golf ball having an outermost spherical surface wherein a plurality of flat surface regions are formed on said outermost spherical surface and the areas except said flat surface regions thereon are left as lands and a dimple is disposed within said plurality of the flat surface regions;

wherein the flat surface regions comprises hexagonal plane regions delimited by six linearly extending ridge-lines; and wherein an apex formed by an intersection of three ridge-lines each serving as a boundary between two adjacent hexagonal plane regions is positioned at a radially farthest point from a center of the golf ball.

20. A golf ball having an outermost spherical surface wherein a plurality of flat surface regions which comprises hexagonal plane regions and pentagonal plane regions are formed on said outermost spherical surface and a dimple is disposed within said plurality of the flat surface regions wherein pentagonal units which are each formed by disposing five hexagonal plane regions closely about one pentagonal plane region are arranged on the spherical surface of the ball.

21. The golf ball of claim 20 wherein three pentagonal units are arranged on a common latitude at intervals of 12020 with respect to the axis connecting two poles of the ball.

22. The golf ball of claim 21 wherein total six pentagonal units are arranged in each hemisphere divided by an equator of the ball.

23. The golf ball of claim 20 wherein hexagonal plane regions are closely disposed over a spherical surface area of the golf ball excluding the pentagonal units.

24. A golf ball having an outermost spherical surface wherein a plurality of flat surface regions which comprises hexagonal plane regions and pentagonal plane regions are formed on said outermost spherical surface and a dimple is disposed within said plurality of the flat surface regions wherein hexagonal units which are each formed by disposing six hexagonal plane regions closely about one hexagonal plane region are arranged on the spherical surface of the ball.

* * * * *